US012758839B2

(12) United States Patent
Parent

(10) Patent No.: US 12,758,839 B2
(45) Date of Patent: Oct. 13, 2026

(54) SPORTS PRACTICE NET

(71) Applicant: Knute Parent, Medford, OR (US)

(72) Inventor: Knute Parent, Medford, OR (US)

( * ) Notice: Subject to any disclaimer, the term of this patent is extended or adjusted under 35 U.S.C. 154(b) by 219 days.

(21) Appl. No.: 18/750,922

(22) Filed: Jun. 21, 2024

(65) Prior Publication Data

US 2024/0424369 A1 Dec. 26, 2024

Related U.S. Application Data

(60) Provisional application No. 63/522,365, filed on Jun. 21, 2023.

(51) Int. Cl.

| | |
|---|---|
| ***A63B 69/36*** | (2006.01) |
| ***A63B 47/02*** | (2006.01) |
| ***A63B 69/00*** | (2006.01) |
| *A63B 102/02* | (2015.01) |
| *A63B 102/18* | (2015.01) |

(52) U.S. Cl.

CPC ..... *A63B 69/0002* (2013.01); *A63B 47/02* (2013.01); *A63B 2069/0006* (2013.01); *A63B 2069/0008* (2013.01); *A63B 2102/02* (2015.10); *A63B 2102/18* (2015.10); *A63B 2243/0025* (2013.01); *A63B 2243/007* (2013.01)

(58) Field of Classification Search

CPC ..... A63B 69/0002; A63B 47/02; A63B 2069/0006; A63B 2069/0008; A63B 2102/02; A63B 2102/18; A63B 2243/0025; A63B 2243/007; A63B 63/00; A63B 69/002; A63B 71/022

USPC ..... 473/150–155, 163, 164, 170–173, 197, 473/198, 421, 432, 434, 435, 454, 456, 473/468, 476, 478

See application file for complete search history.

(56) References Cited

U.S. PATENT DOCUMENTS

| | | | | | |
|---|---|---|---|---|---|
| 3,452,985 | A * | 7/1969 | Zmura | A63B 67/04 | 473/475 |
| 4,883,272 | A * | 11/1989 | Lay | A63B 63/00 | 473/436 |
| 5,286,029 | A * | 2/1994 | Smit | A63B 63/00 | 473/196 |
| 6,315,677 | B1 * | 11/2001 | Sandlin | A63B 71/022 | 473/197 |
| 6,926,060 | B2 * | 8/2005 | Mark | A63B 71/022 | 135/133 |
| 7,731,198 | B2 * | 6/2010 | Cho | A63B 63/00 | 273/400 |
| 8,668,603 | B2 * | 3/2014 | Hammons | A63B 47/025 | 473/421 |
| 2005/0077014 | A1 * | 4/2005 | Mark | E04B 2/7416 | 160/135 |
| 2005/0176518 | A1 * | 8/2005 | Doherty | A63B 47/025 | 473/170 |

(Continued)

*Primary Examiner* — Nini F Legesse

(74) *Attorney, Agent, or Firm* — McCoy Russell LLP

(57) ABSTRACT

A sports ball practice net is provided for catching balls impacting and redirecting them to a container. The practice net includes a frame for positioning on a support surface and a plurality of net panels extending at different angles from a common center. A collection panel situated between the frame and lower edges of the net panels collects balls after impacts with the net panels and directs them through an opening wherein a container is employable to hold the balls.

14 Claims, 4 Drawing Sheets

(56) References Cited

U.S. PATENT DOCUMENTS

2015/0258403 A1* 9/2015 Myers ..... A63B 67/002
473/476

* cited by examiner

SPORTS PRACTICE NET

BACKGROUND OF THE INVENTION

1. Field of the Invention

This application claims priority to U.S. Provisional patent application Ser. No. 63/522,365 filed on Jun. 21, 2023. The invention herein disclosed relates generally to nets employed for sports, such as baseball and tennis and the like. More particularly, it relates to a portable net employable to practice hitting a ball which will receive incoming balls from multiple directions and deposit them into a container.

2. PRIOR ART

Background of the Invention

In sports which employ a ball during play, such as baseball, there is an ongoing need for players to practice batting and throwing and pitching of the baseball. While such practice is easily accomplished on a ball field with multiple players to throw and pitch the ball, practice off the field is problematic.

Modernly, netting structures are employed for such practice. These netting structures, for example, may be a batting cage which is surrounded by netting which will catch struck balls and cause them to fall to the ground. Another such practice device employs a netting structure which will contact a ball which is hit or thrown into the net and cause the ball to drop. Such netting structures may be permanent or portable and conventionally employ a frame or other structure to hold one or a plurality of netting panels above a support surface.

With respect to the above, before explaining at least one preferred embodiment of the sports practice net device herein, it is to be understood that the disclosed device herein is not limited in its application to the details of employment and to any arrangement of steps set forth in the following description or illustrated in the drawings. The various apparatus components and configurations and methods of employment thereof as herein disclosed, are capable of other embodiments, and of being practiced and carried out in various ways, all of which will be obvious to those skilled in the art once the information herein is reviewed.

Also, it is to be understood that the phraseology and terminology employed herein are for the purpose of description for an understanding of the ball practice device and system herein and should not be regarded as limiting. As such, those skilled in the art will appreciate that the conception upon which this disclosure is based may readily be utilized as a basis for other ball sports practice devices and systems. It is important, therefore, that the embodiments, objects and claims herein, be regarded as including such equivalent construction and methodology insofar as they do not depart from the spirit and scope of the present invention.

SUMMARY OF THE INVENTION

The apparatus and system herein provides a portable and easily employed and transported net structure for use in capturing thrown or batted balls during practice. The device employs a novel structure of using a plurality of individual impact net panels. Currently, four impact net panels are used each of which extend from a common center.

Each impact net panel is supported at an upper end thereof by a connection to a frame structure. Vertical sides of the impact net panels are reinforced with an edge having an axial passage for insertion of the flexible members and thereby acts to hold the netting panel substantially planar. The impact net may be formed of a plurality of net panels extending from the common center section. This plurality may be two, three, four, five, or six or more. Currently, a plurality of four net panels works well for ball contact of baseballs and soccer balls or footballs. Where a plurality of four net panels forms the device, preferably, each impact net panel extending from the common center section is substantially perpendicular to two adjacent impact net panels. This forms four sections into which balls may be thrown or struck and captured upon an impact with any of the vertically disposed impact net panels.

Unique to the netting device herein is the function of communicating each captured ball from any of the vertically positioned impact net panels, to a single opening which may be positioned above a container. The container will thus capture all balls which are hit or thrown or otherwise communicated along a trajectory which impacts one of the vertical net panels.

In communicating captured balls to a single outlet or opening, the device employs a horizontally disposed collection panel which is situated under a lower edge of each of the vertically positioned impact net panels. Upon an impact against any one of the vertical impact net panels, the netting thereof will rise slightly to a position which negates the force of the ball impact. Thereafter, the ball will simply drop toward the horizontally disposed collection panel.

The horizontally disposed ball collection panel has an opening therethrough which is centrally located. Consequently, a ball dropping subsequent to a contact with a vertically positioned net panel will fall onto the horizontally positioned ball collection panel. Upon contact with the ball collection panel, the ball will roll toward the opening located in the central area thereof. Preferably, the central area of the ball collection panel is positioned lower than the surrounding net area such as by forming a slant from the perimeter edge of the ball collection panel toward the lower centrally located opening.

A container may be positioned under the ball collection panel below the centrally positioned opening therein. In this fashion, all balls thrown or hit or otherwise directed into any of the vertically disposed impact net panels can be directed into a single container making retrieval of the balls an easy task.

The frame to support both the impact net panels and the collection panel may be formed of metal or a polymeric material or composite material. Preferably, the frame is formed of easily engaged sections to which the flexible members are positioned upright. Being formed of flexible material such as plastic or polymeric material or metal or fiberglass, the flexible members when engaged to the sides of the net panels bias the net panels away from a center section. This biasing allows for a more planar positioning of the surface of the net panels for ball impacts. The ability to remove the flexible members from both the frame and the net panels allows for easy transport and setup of the practice device. Upper edges of each of the impact net panels may be reinforced with edging to help maintain the shape of the formed impact nets and to hold them erect. Elastic members or rope or cable may also be employed to hold the upper edges of each of the net panels in a secure position on the frame.

The material employed for both the impact net panels and the collection panel may be conventional woven, knitted, or knotted sports netting, or may be woven fabric, or vinyl fabric, or other fabric or netting which will absorb the impact of a ball and cause it to drop downward. Netting or a mesh material is preferred in that it allows wind therethrough. Openings on the netting or mesh fabric material will be smaller than the circumference of the ball which they will contact during use.

With respect to the above summary description, before explaining at least one preferred embodiment of the ball sports practice device system herein, it is to be understood that the invention is not limited in its application to the details of operation nor the arrangement of the components or the steps set forth in the following description or illustrations in the drawings. The various methods of implementation and operation of the ball sport practice device herein, are capable of other embodiments and of being practiced and carried out in various ways which will be obvious to those skilled in the art upon their review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis by others for designing of other modes for carrying out the several purposes of the present ball sports practice device and system. Therefore, the objects and claims herein should be regarded as including such equivalent construction, steps, and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Where used herein, if not otherwise defined, the term "substantially" means plus or minus five percent.

It is an object of this invention to provide a ball practice device which will capture thrown and struck balls from multiple directions.

It is a further object of this invention to provide such a ball sports practice device which will receive the impact of incoming balls from varying and multiple directions and communicate them all through a single exit where a ball container may be situated.

These together with other objects and advantages, which become subsequently apparent, reside in the details of the construction and operation of the ball sports practice device and system herein as more fully hereinafter described and claimed, reference being had to the accompanying drawings forming a part thereof, wherein like numerals refer to like parts throughout.

Further objectives of this invention may be ascertained by those skilled in the art as brought out in the following part of the specification wherein detailed description is for the purpose of fully disclosing the invention without placing any limitations thereon.

BRIEF DESCRIPTION OF DRAWING FIGURES

The accompanying drawings, which are incorporated herein and form a part of the specification, illustrate some but not the only or exclusive examples of embodiments and/or features of the disclosed rocking ball sports practice device and system herein. It is intended that the embodiments and figures disclosed herein are to be considered illustrative of the invention herein, rather than limiting in any fashion. In the drawings.

DETAILED DESCRIPTION OF THE PREFERRED EMBODIMENTS OF THE INVENTION

Figure 1:
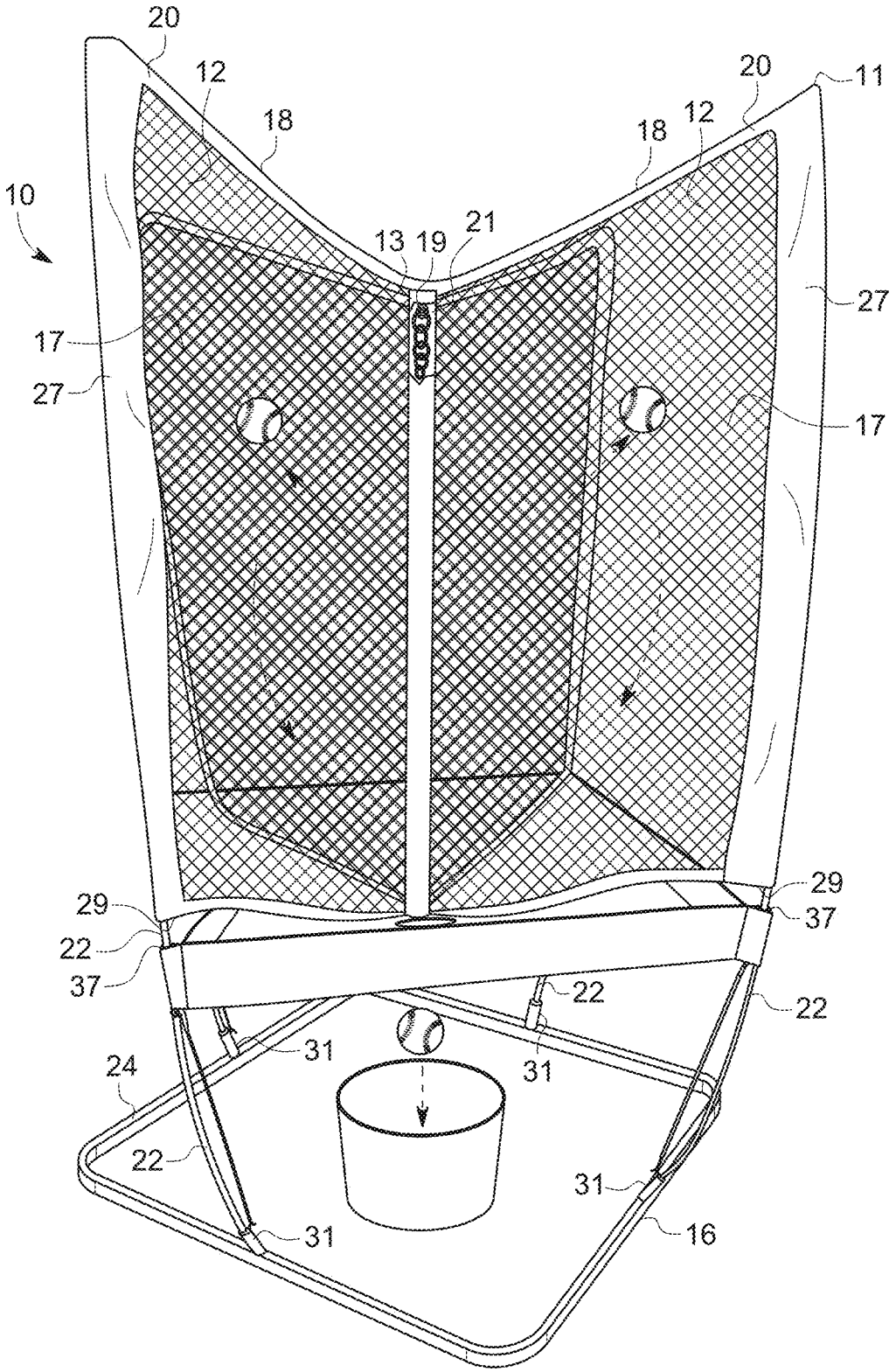
FIG. 1 shows a view of the ball sports practice device herein in an as-used positioning where it is assembled with a plurality of impact nets engaged and extending from a common center connector. The impact nets forming the net body extend from the center connector preferably to a slide-on engagement with upright flexible members which are removably engaged to a frame.
Figure 2:
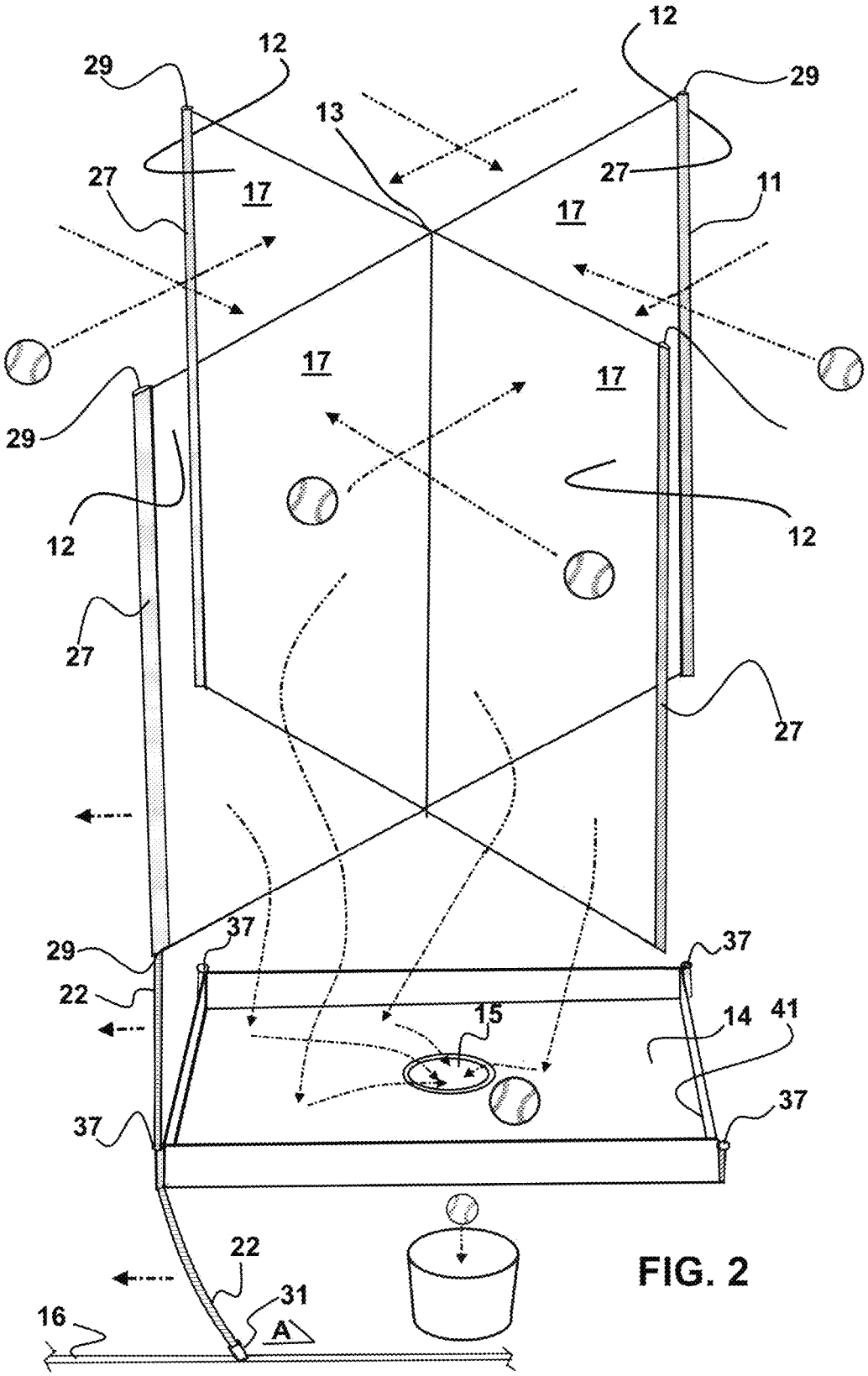
FIG. 2 is a graphic depiction of a device herein having a net body formed of a plurality of four net panels shown the operation and configuration of the sports ball practice device of FIGS. 1 and 3 and showing the omnidirectional function of the device to receive incoming balls from substantially any direction and to redirect the received balls to a lower collection section having an exit opening.
Figure 3:
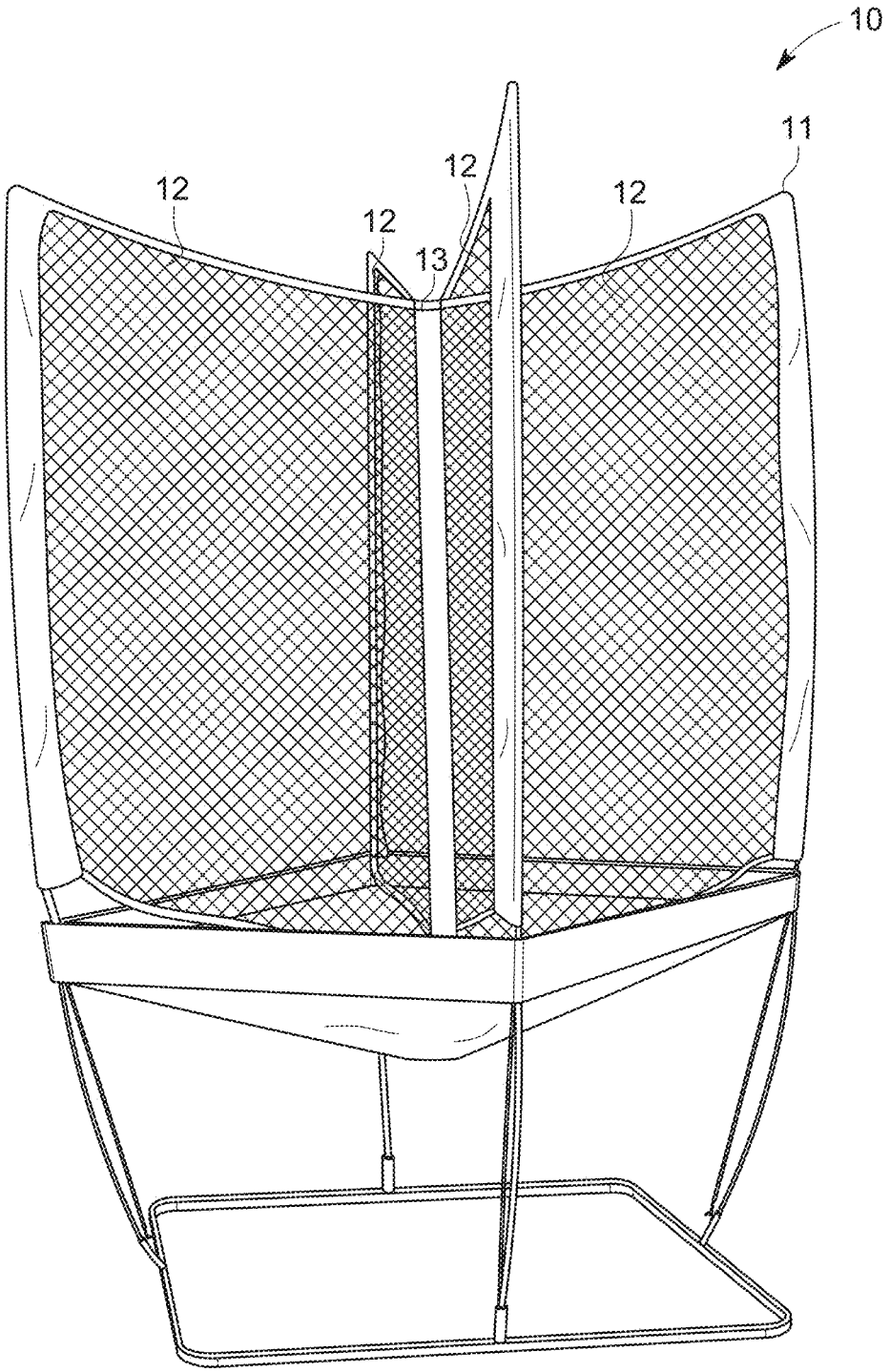
FIG. 3 depicts the device herein in an assembled and as-used positioning on a sports field, such as a baseball, football, or soccer field ready for impact and collection of balls.
Figure 4:
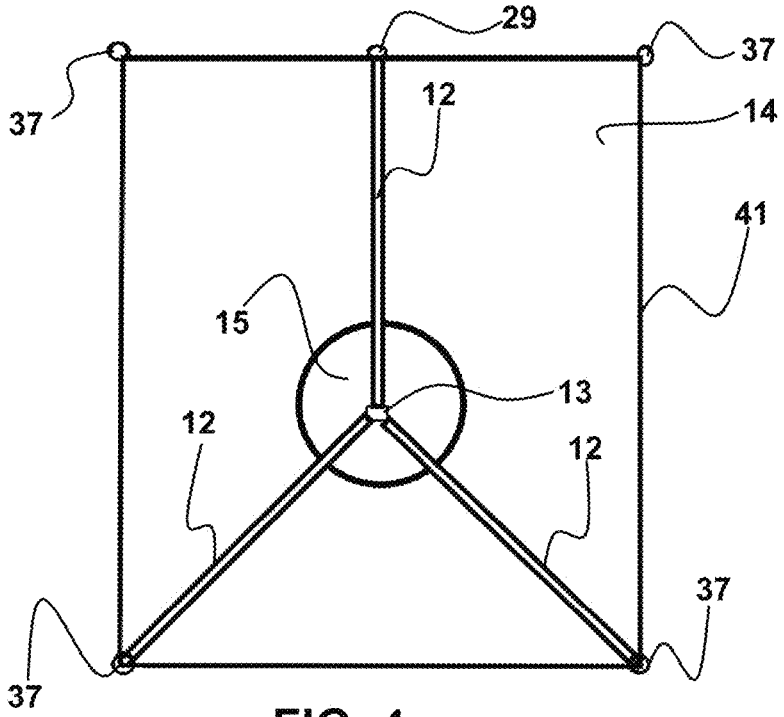
FIG. 4 is an overhead view of a graphic depiction of the device herein showing a net body having a plurality of three net panels extending from a common center connector and showing the collection panel at a bottom end of the net body having a ball opening for communicating dropped balls to a container.

In this description, the directional prepositions of up, upwardly, down, downwardly, front, back, top, upper, bottom, lower, left, right, first, second, and other such terms refer to the ball practice device as it is oriented and appears in the drawings and all such terms are used for convenience only and such are not intended to be limiting or to imply that the sports ball practice device and system has to be used or positioned in any particular orientation.

Now referring to drawings in FIGS. 1-5, there is seen in the various figures, such as 1-3, the device 10 in an operational positioning where a plurality of vertically disposed impact net panels 12 and a collection panel 14 are operatively supported by a frame 16.

A current preferred plurality of impact net panels 12 includes, for example, four vertically disposed impact net panels 12 extending radially from a common center connector 13 to which they are engaged on a respective first side of each net panel 12. This has been found, in experimentation, to provide the ability of the device 10 to capture balls contacting any of the impact net panels 12 from virtually any angle.

An upper edge 18 of each of the impact net panels 12 may be reinforced with edging 20 which may be sewn on or otherwise engaged to the top side of the net panels 12. This edging 20, once engaged, may be stretched by the biasing of the flexible upright members 22 which extend from engagements at first ends thereof to the base 24 portion of the frame 16. A surface area 17 of each net panel 12 located between the top and bottom and first side and second side provides a soft area for contact of balls there against, causing the ball to stop forward acceleration and fall downward.

The upright members 22 are formed of flexible and elastic material such that when bent inward toward a center connector 13 of the device 10 during installation of the net body 11 thereon, they will then impart a biasing force away from the direction of the center connector 13. This imparts a biasing force to each of the net panels 12 in a direction away from a flexible center connector 13 to which each of the net panels is engaged and extends therefrom.

The center connector 13, in a particularly preferred mode of the device herein, has weights 19 engaged thereto. While the device 10 works well to contact and collect balls without weights 19 the weights act to absorb more of the ball impact to the net panels 12 which must lift the weighted center connector 13. This lifting slows the balls more quickly. By weights engaged to the center connector 13 is meant any weight material, such as metal or ceramic materials. Currently, chain is employed for the weights 19 and located within an interior passage 21 of the center connector 13 for substantially the length of the center connector 13. This elongated positioning provides weight resistance to negate the impact of balls anywhere on each net panel 12.

The upper edge 18 of the net body 11 may be secured to a support member, such as rope or cable or elastic rope which may be engaged with the uprights 22. This will provide a taut engagement of each of the upper ends 18 of the plurality of vertically disposed impact net panels 12. However, the employment of the flexible members 22 inserted into passages 29 of the edge panel 27 and the taut positioning of the net body 11, provided thereby, is preferred to make the device 10 easier to assemble and disassemble.

As noted, sides and lower edges of each of the vertically disposed impact net panel 12 may be edged with an edge panel 27 which, once engaged by sewing or otherwise, will help maintain the shape of each impact net panel 12. In a particularly preferred mode of the device 10, the flexible members 22 are positioned in a sliding engagement into passages 29 formed within the edge panels 27 located on the side edges of each net panel 12 opposite the central connector 13.

The flexible members 22 engage with mounts 31 positioned on the frame 24 at a first end of the flexible members 22. The mount is positioned to removably hold the first end of each flexible member 22 at an angle A extending in a direction away from the center of the frame 24 and away from the center connector 13, once the net body 11 is engaged. This outward or angled extension requires the flexible members 22 to be bent back toward the center connector 13 during assembly. Such generates the biasing force to be imparted by the flexible members 22 to the exterior side edges of each net panel 12, since they must be bent back toward the center of the frame 24 and the center connector 13 by force when they are inserted into the passages 29.

As noted, to ease the effort required to assemble the device 10 on the frame 16, the plurality of impact net panels 12 are preferably engaged along their first side to the flexible common center connector 13. This engagement may be sewing or using rivets or mechanical connectors or otherwise connecting a first side of each impact net panel 12 to the center connector.

The collection panel 14 may be formed of the same netting or other flexible material as the vertical impact net panels 12 or it may be formed of an impact resistant fabric such a polypropylene shade cloth, laminated or coated vinyl, or truck cover fabric, or a similar strong fabric. Preferably, the material for the collection panel 14 and any fabric or netting used herein will have a high U.V. resistance to allow outdoor use where sunlight can damage fabrics and netting.

The collection panel 14, as noted, will have an opening 15 formed in a central area thereof. The collection panel 14 may also be formed whereby the fabric or netting forming it will slant downward from the perimeter edge 41 of the collection panel 14. Such a downward slant will encourage balls dropping from the impact net panels 12 onto the collection panel 14 to roll toward and through the formed opening 15 in the central area thereof. A container (not shown but well known) may be positioned under the opening 15 in the collection panel 14 and will thereby collect all balls which fall through the opening 15.

The perimeter edge 41 of the collection panel 14 is preferably configured to easily engage it in a horizontal disposition to the frame 16. This may include grommets, loops, or other means for engagement of the perimeter edge to the frame 16. Currently preferred are side passages 37 through which one of the flexible members 22 will slide and be positioned therein.

Here to, the outward biasing force of the plurality of flexible members 22 exerted against each such side passage 37 will hold the collection panel 14 taught and elevated above a collection device for balls such as a bucket. The use of the side passages 37 positioned around the perimeter edge of the collection panel 14 in locations which align with some or all the 29 passages, eliminates the need for mechanical or other connections which might get lost and renders the device 10 especially easy to assemble. In modes of the device 10 wherein there are more net panels 12 in the plurality only some of the passages 29 may align with the side passages 37 in a manner to support the collection panel 14 elevated and below the assembled net body 11.

The device 10 herein, as noted, can be configured with a net body 11 having any number of net panels 12 extending radially from a center connector 13 to which a first side of each net panel 12 is connected. By extending radially is meant that a surface area of each net panel extends radially from the first side thereof to an opposite second side thereof at a different angle than the other net panels 12. For example, a net body 11 with four net panels 12 will preferably have each extending at an angle of substantially ninety degrees, thereby positioning each surface area 17 of each net panel 12 in the net body 11 running perpendicular to that of an adjacent net panel 12. Another example may have a net body 11 with three net panels 12 which will have the surface areas of the net panels 12 extending at 120 degrees relative to any adjacent net panel 12. Of note, the center connector 13 herein is shown as an elongated flexible portion of material since, as noted, it is preferably weighted. However, the center connector 13 herein may also be an engagement of one side of each net panel 12 to the others without using material or webbing or the like for the center connector 13.

Figure 5:
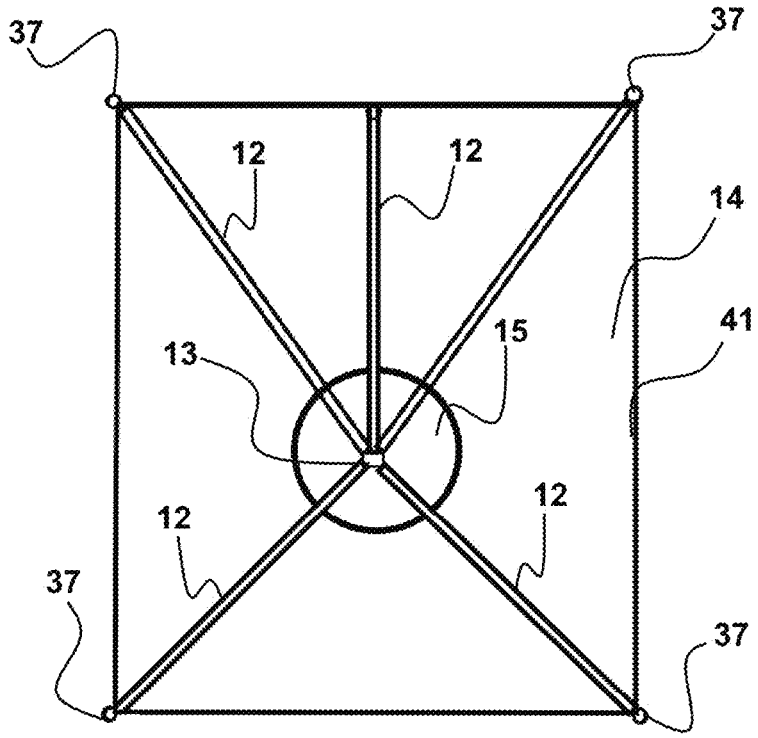
FIG. 5 is a graphic depiction of the device herein having a plurality of five net panels forming the net body herein which is situated over the collection panel and opening.

In FIG. 5 is shown an example of the device 10 wherein the net body 11 has a plurality of three net panels extending from a common center connector 13 which may be actual fabric or webbing or may simply be a connection of the sides of the three net panels 12. Also shown is the collection panel 14 at a bottom end of the net body 11 having a ball opening 15 formed therethrough for communicating dropped balls to a container. Another example of a plurality of net panels 12 forming a net body 11 is shown in FIG. 5. As shown in this graphic depiction of the device 10, a plurality of five net panels 12 may be engaged at a common center connector and extend radially therefrom. As in FIG. 4, the net body 11 herein which is situated over the collection panel 14 having the opening 15 through which impacted balls will pass for easy collection in a container.

While all of the fundamental characteristics and features of the disclosed sports ball practice device and system herein, have been shown herein, with reference to particular embodiments thereof, a latitude of modification, various changes and substitutions are intended in the foregoing disclosure. It will be apparent that in some instances, some features of the invention may be employed without a corresponding use of other features without departing from the scope of the invention as set forth.

It should also be understood that various substitutions, modifications, and variations may be made by those skilled in the art, upon viewing this disclosure without departing from the spirit or scope of the invention. Consequently, all such modifications and variations and substitutions are considered included within the scope of the invention as defined by the following claims.

What is claimed is:

1. A sports ball practice net apparatus comprising:

a frame for positioning upon a support surface;

a net body supported above said frame;

said net body having a plurality of net panels, each said net panel having a surface area surrounded by a first side, a second side and an upper edge and a lower edge;

each of said net panels connected on a respective first side thereof at a center connector;

said surface area of each of said plurality of net panels extending radially from said center connector whereby each respective surface area of each said net panel extends radially at different angles from said center connector;

a collection panel located in an elevated position between said frame and said lower edges of each respective said net panel of said net body, said collection panel having a collection surface area surrounded by a perimeter edge of said collection panel;

said collection panel having an opening communicating therethrough in a central area of a collection surface of said collection panel;

each respective said surface area defining a contact surface for balls to impact thereon and subsequently fall toward said collection surface; and the opening in said collection panel defining a passage for said balls to pass therethrough, wherein said balls impacting said surface areas of said net panels at said different angles are redirected to fall upon said collection surface and drop through said opening.

2. The sports ball practice net apparatus of claim 1 additionally comprising:

a plurality of flexible members, each extending from a respective first end thereof engaged with a respective mount positioned on said frame, to a second end thereof;

each of said net panels in a connection at a respective second side thereof with one respective flexible member; and each said flexible member imparting a biasing in force to the respective said net panel to urge said second end thereof away from said center connector.

3. The sports ball practice net apparatus of claim 2 wherein said connection at said second side of each of said net panels with said flexible member comprises a positioning of said flexible member within a passage running along said second side of each said net panels.

4. The sports ball practice net apparatus of claim 3 additionally comprising:

said mount engaging said first end of each said mount engaging said first end of said flexible members is angled to project said flexible member in a direction away from said center connector.

5. The sports ball practice net apparatus of claim 3 wherein said collection panel is held in said elevated position by a plurality of side passages located at the perimeter of said collection panel where said side passages have a said flexible member running therethrough.

6. The sports ball practice net apparatus of claim 3 additionally comprising:

said center connector having one or a plurality of weights positioned thereon.

7. The sports ball practice net apparatus of claim 2 additionally comprising:

said mount engaging said first end of each said mount engaging said first end of said flexible members is angled to project said flexible member in a direction away from said center connector.

8. The sports ball practice net apparatus of claim 7 wherein said collection panel is held in said elevated position by a plurality of side passages located at the perimeter of said collection panel where said side passages have a said flexible member running therethrough.

9. The sports ball practice net apparatus of claim 7 additionally comprising:

said center connector having one or a plurality of weights positioned thereon.

10. The sports ball practice net apparatus of claim 2 wherein said collection panel is held in said elevated position by a plurality of side passages located at the perimeter of said collection panel where said side passages have a said flexible member running therethrough.

11. The sports ball practice net apparatus of claim 4 wherein said collection panel is held in said elevated position by a plurality of side passages located at the perimeter of said collection panel where said side passages have a said flexible member running therethrough.

12. The sports ball practice net apparatus of claim 11 additionally comprising:

said center connector having one or a plurality of weights positioned thereon.

13. The sports ball practice net apparatus of claim 2 additionally comprising:

said center connector having one or a plurality of weights positioned thereon.

14. The sports ball practice net apparatus of claim 1 additionally comprising:

said center connector having one or a plurality of weights positioned thereon.

* * * * *